US011619011B2

(12) United States Patent
Berning et al.

(10) Patent No.: US 11,619,011 B2
(45) Date of Patent: *Apr. 4, 2023

(54) SELF-PROPELLED CONSTRUCTION MACHINE AND METHOD FOR CONTROLLING A SELF-PROPELLED CONSTRUCTION MACHINE

(71) Applicant: Wirtgen GmbH, Windhagen (DE)

(72) Inventors: Christian Berning, Zülpich (DE); Martin Lenz, Grossmaischeid (DE); Cyrus Barimani, Königswinter (DE)

(73) Assignee: Wirtgen GmbH

( * ) Notice: Subject to any disclaimer, the term of this patent is extended or adjusted under 35 U.S.C. 154(b) by 0 days.

This patent is subject to a terminal disclaimer.

(21) Appl. No.: 17/381,314

(22) Filed: Jul. 21, 2021

(65) Prior Publication Data

US 2022/0178090 A1 Jun. 9, 2022

Related U.S. Application Data

(63) Continuation of application No. 16/373,875, filed on Apr. 3, 2019, now Pat. No. 11,072,893, which is a (Continued)

(30) Foreign Application Priority Data

Aug. 28, 2014 (DE) ..... 10 2014 012 825.3

(51) Int. Cl.
*E01C 23/01* (2006.01)
*E01C 23/088* (2006.01)
*E01C 23/12* (2006.01)

(52) U.S. Cl.
CPC ..... *E01C 23/01* (2013.01); *E01C 23/088* (2013.01); *E01C 23/127* (2013.01)

(58) Field of Classification Search
CPC ..... E01C 23/088; E01C 23/127; E01C 23/01; E01C 23/0933; E01C 23/0946; E01C 23/0993
(Continued)

(56) References Cited

U.S. PATENT DOCUMENTS 3,101,175 A * 8/1963 Brown, Jr. ..... E01C 23/166 239/150
5,169,262 A 12/1992 Wilson et al.
(Continued)

FOREIGN PATENT DOCUMENTS

DE 19750315 A1 5/1998
DE 69131837 1/2000
(Continued)

OTHER PUBLICATIONS

Australian Patent Examination Report No. 1 in corresponding Australian Patent Application No. AU 2015218516 dated Feb. 16, 2016, 6 pp. (not prior art).

*Primary Examiner* — Abby J Flynn
*Assistant Examiner* — Michael A Goodwin
(74) *Attorney, Agent, or Firm* — Gary L. Montle; Lucian Wayne Beavers; Patterson Intellectual Property Law, PC

(57) ABSTRACT

The invention relates to a self-propelled construction machine, in particular a road milling machine, which possesses an undercarriage which has front and rear—in the working direction—wheels or travelling gears, a machine frame which is borne by the undercarriage, and a working means. Furthermore, the invention relates to a method for controlling a self-propelled construction machine, in particular a road milling machine. The invention is based on the detection of objects O situated in the ground at a time at which the objects O can be readily detected. The construction machine according to the invention possesses a means for generating predictive object signals which are charac-
(Continued)

teristic of the position of objects which lie in a portion of the ground which lies in the working direction A in front of the working region of the working means. Furthermore, the construction machine has a signal processing means which receives the object signals, which means is configured such that during the advance of the construction machine object signals relating to the working means are obtained from the predictive object signals, these signals being characteristic of the position of the objects in a portion of the ground which relates to the working region of the working means.

12 Claims, 9 Drawing Sheets

Related U.S. Application Data continuation of application No. 15/914,000, filed on Mar. 7, 2018, now Pat. No. 10,273,642, which is a continuation of application No. 14/835,905, filed on Aug. 26, 2015, now Pat. No. 9,915,041.

(58) Field of Classification Search
USPC ..... 382/103
See application file for complete search history.

(56) References Cited

U.S. PATENT DOCUMENTS

| | | | |
|---|---|---|---|
| 5,288,167 | A | 2/1994 | Gaffard et al. |
| 5,296,256 | A | 3/1994 | Hartman |
| 5,519,620 | A | 5/1996 | Talbot et al. |
| 5,549,412 | A | 8/1996 | Malone |
| 5,607,205 | A | 3/1997 | Burdick et al. |
| 5,612,864 | A | 3/1997 | Henderson |
| 5,631,658 | A | 5/1997 | Gudat et al. |
| 5,838,277 | A | 11/1998 | Loomis et al. |
| 5,929,807 | A | 7/1999 | Viney et al. |
| 5,947,385 | A | 9/1999 | Lanerd et al. |
| 6,027,282 | A | 2/2000 | Horn |
| 6,047,227 | A | 4/2000 | Henderson et al. |
| 6,074,693 | A | 6/2000 | Manning |
| 6,088,644 | A | 7/2000 | Brandt et al. |
| 6,113,309 | A | 9/2000 | Hollon et al. |
| 6,140,957 | A | 10/2000 | Wilson et al. |
| 6,144,318 | A | 11/2000 | Hayashi et al. |
| 6,152,648 | A | 11/2000 | Gfroerer et al. |
| 6,191,732 | B1 | 2/2001 | Carlson et al. |
| 6,287,048 | B1 | 9/2001 | Hollon et al. |
| 6,371,566 | B1 | 4/2002 | Haehn |
| 6,425,186 | B1 | 7/2002 | Oliver |
| 6,481,924 | B1 | 11/2002 | Smolders et al. |
| 6,655,465 | B2 | 12/2003 | Carlson et al. |
| 6,736,216 | B2 | 5/2004 | Savard et al. |
| 6,769,836 | B2 | 8/2004 | Lloyd |
| 6,916,070 | B2 | 7/2005 | Sehr |
| 6,950,059 | B2 | 9/2005 | Rapoport et al. |
| 7,002,513 | B2 | 2/2006 | Brabec et al. |
| 7,029,199 | B2 | 4/2006 | Mayfield et al. |
| 7,363,154 | B2 | 4/2008 | Lindores |
| 7,399,139 | B2 | 7/2008 | Kieranen et al. |
| 7,443,167 | B2 | 10/2008 | Siegel et al. |
| 7,491,014 | B2 | 2/2009 | Sick |
| 7,510,347 | B2 | 3/2009 | Lemke |
| 7,530,641 | B2 | 5/2009 | Berning et al. |
| 7,617,061 | B2 | 11/2009 | Brabec |
| 7,643,923 | B2 | 1/2010 | Buehlmann et al. |
| 7,717,521 | B2 | 5/2010 | Hall et al. |
| 7,856,302 | B2 | 12/2010 | Rasmussen |
| 7,946,787 | B2 | 5/2011 | Glee et al. |
| 7,946,788 | B2 | 5/2011 | Jurasz et al. |
| 8,018,376 | B2 | 9/2011 | McClure et al. |
| 8,174,437 | B2 | 5/2012 | Whitehead |
| 8,246,270 | B2 | 8/2012 | Berning et al. |
| 8,271,194 | B2 | 9/2012 | Whitehead et al. |
| 8,388,263 | B2 | 3/2013 | Fritz et al. |
| 8,613,566 | B2 | 12/2013 | Fritz et al. |
| 8,977,442 | B2 | 3/2015 | Menzenbach et al. |
| 8,989,968 | B2 | 3/2015 | Fritz et al. |
| 9,096,977 | B2 | 8/2015 | Fritz et al. |
| 2004/0057795 | A1 | 3/2004 | Mayfield et al. |
| 2004/0193348 | A1 | 9/2004 | Gray et al. |
| 2008/0152428 | A1* | 6/2008 | Berning ..... E01C 23/088 404/84.1 |
| 2008/0208417 | A1 | 8/2008 | Buehlmann et al. |
| 2008/0216021 | A1 | 9/2008 | Berning et al. |
| 2008/0253834 | A1 | 10/2008 | Colvard |
| 2009/0015056 | A1 | 1/2009 | Hall et al. |
| 2009/0016818 | A1 | 1/2009 | Hall et al. |
| 2010/0023229 | A1 | 1/2010 | Chiocco |
| 2011/0150572 | A1 | 6/2011 | Fritz et al. |
| 2011/0206456 | A1 | 8/2011 | Jurasz et al. |
| 2011/0229264 | A1 | 9/2011 | Weiser |
| 2012/0001621 | A1 | 1/2012 | Hall et al. |
| 2012/0001638 | A1 | 1/2012 | Hall et al. |
| 2012/0101725 | A1 | 4/2012 | Kondekar |
| 2012/0301220 | A1 | 11/2012 | Snoeck et al. |
| 2014/0081532 | A1 | 3/2014 | Fritz et al. |
| 2014/0348584 | A1 | 11/2014 | Fritz et al. |
| 2015/0035693 | A1 | 2/2015 | Hall et al. |
| 2015/0176990 | A1 | 6/2015 | Fritz et al. |

FOREIGN PATENT DOCUMENTS

| | | | |
|---|---|---|---|
| DE | 29918747 | U1 | 3/2000 |
| DE | 102010014695 | A1 | 10/2011 |
| DE | 102010048185 | A1 | 4/2012 |
| DE | 102013006464 | A1 | 10/2013 |
| EP | 1103659 | A2 | 5/2001 |
| EP | 1118713 | A1 | 7/2001 |
| EP | 2336424 | A2 | 6/2011 |
| EP | 2719829 | | 4/2014 |
| WO | 9203701 | A1 | 3/1992 |
| WO | 2013177516 | A1 | 11/2013 |

* cited by examiner 18
23
23D
22D
22
22A
23A
22B
23B
23C
22C

20E
$x_2$
21E
20
20D
$x_1$
22
22D
20A 21
22A
22B
9'
8
9
O
20B
22C
A
20C
x 20
20A
8
7
20C
20D
7
20E
20B 21
22
22A
22B
22C
22D
21E
x 18
22
22A
23A
23
23D
22D
22B
23B
9
23C
22C
9'

SELF-PROPELLED CONSTRUCTION MACHINE AND METHOD FOR CONTROLLING A SELF-PROPELLED CONSTRUCTION MACHINE

BACKGROUND OF THE INVENTION

1. Field of the Invention

The invention relates to a self-propelled construction machine, in particular a road milling machine, which possesses an undercarriage which has front and rear—in the working direction—wheels or travelling gears, a machine frame which is borne by the undercarriage and a working means. Furthermore, the invention relates to a method for controlling a self-propelled construction machine, in particular a road milling machine.

2. Description of the Prior Art

Various types of self-propelled construction machine are known. These machines include for example the known road milling machines or slipform pavers. These construction machines are distinguished in that they possess a working means for altering the ground or for constructing structures on the ground. In the known road millers, the working means has a milling drum equipped with milling implements, with which material can be milled off from the road surface in a specified working region.

When planning and executing a construction project which is to be carried out with the known road milling machines, the problem arises that objects already present in the ground, for example manhole covers, storm drains or hydrants, have to be taken into account. The region of the ground in which for example a manhole cover lies should not be altered using the road miller, since the manhole cover and the road miller might otherwise be damaged.

In order to take into account objects present in the ground, it is necessary to intervene in the machine control. The milling drum of a road milling machine, for example when travelling over a manhole cover, has to be raised out of a specified position in relation to the surface which is to be altered taking into account a safety distance within a specified stretch or distance, which is dependent on the dimensions of the manhole cover. The operator of the machine cannot, however, recognise the exact position of the manhole cover level with the milling drum in practice, since the milling drum is located beneath the driving position. Therefore the position of a manhole cover in the ground in practice is marked with lateral lines which can be recognised by the operator of the machine or another person. However, it proves disadvantageous in practice to mark objects which are present in the ground. First of all, to mark the objects requires an additional working step. Furthermore, it is difficult to draw the lines exactly at a right-angle to the direction of travel. Further, the lines cannot be recognised, or can be recognised only with difficulty, when it is dark. Moreover, it is not readily possible to mark the objects if it is raining. Because of the inaccuracies, it is therefore necessary to select a relatively large safety distance, which makes a greater amount of subsequent work necessary.

The use of a display unit to simplify handling of a construction machine is known from DE 10 2010 048 185 A1 (U.S. Pat. No. 8,977,442). DE 10 2010 048 185 A1 however describes a means for facilitating the maneuvering of a construction machine on the ground, which means uses sensors to detect the steering angle of the travelling gears which has been set by the operator of the machine. Trajectories which describe the path of travel of the construction machine are displayed for the operator of the machine on the display unit.

US 2009/0016818 A1 and US 2012/0001638 A1 describe construction machines which possess a means for recognising metallic objects which may lie beneath the ground surface. If a metal object is recognised, the road milling machine can be stopped or the milling drum can be raised. The objects concealed in the ground can be recognised using a metal detector.

SUMMARY OF THE INVENTION

It is an object of the invention to provide a self-propelled construction machine, in particular a road milling machine, with which control of the construction machine is simplified in practice, taking into account objects present in the ground. A further object of the invention is to devise a method with which control of the construction machine can be simplified, taking into account objects present in the ground.

These objects are achieved according to the invention with the features of the independent claims. The subjects of the dependent claims relate to preferred embodiments of the invention.

The construction machine according to the invention and the method according to the invention for controlling the construction machine are based on the detection of the objects located in the ground at a time at which the objects can readily be detected, since they are not covered by parts of the machine at this time. Although the objects are detected in advance, the operator of the machine receives the information necessary to control the construction machine at the time at which it is necessary to intervene in the machine control because of the objects.

The construction machine according to the invention possesses a means for generating predictive object signals which are characteristic of the position of objects lying in a portion of the ground which lies in the working direction in front of the working region of the working means. In this ground portion, which lies outside the working region of the working means, the objects can be readily detected by the means for generating predictive object signals.

In this connection, "object signals" are understood to mean all signals which contain information on the position of the objects. These signals may describe the position of only one reference point or a plurality of reference points of the objects. For example, the signals may describe the outlines of the objects. In a preferred embodiment of the invention, the object signals are image signals with which the objects can be represented as individual images or a sequence of images (video). What is crucial is that with the object signals the operator of the machine obtains sufficient information (data) about the position of the objects to be able to intervene in the machine control. This intervention in the machine control may however also take place automatically.

Furthermore, the construction machine has a signal processing means which receives the predictive object signals, which means is configured such that during the advance of the construction machine object signals relating to the working means can be obtained from the predictive object signals, these signals being characteristic of the position of the objects in a portion of the ground which relates to the working region of the construction machine. This portion also comprises, preferably in addition to the portion of the ground in which the working region of the working means lies, a portion which lies in the working direction in front of or behind the working region of the construction machine and optionally also laterally thereto, i.e. the ground portion which directly adjoins the working region of the construction machine. Of these portions, only partial portions need to be detected. Consequently, the region in which the working means of the construction machine is moving towards the object or away from the object can be detected. If the object is approaching the working region or is leaving the working region, it is possible, taking into account a specified safety distance between the object and the working region of the working means, to intervene in the machine control, for example the milling drum can be raised or lowered or the construction machine stopped. This intervention may take place manually or alternatively automatically. Therefore current object signals which give the operator of the machine the necessary information are obtained from the predictive object signals. The signal processing means may be a separate processing unit or part of the central processing and control unit of the construction machine.

The current object signals relating to the working region of the working means are preferably obtained from the predictive object signals taking into account the period in which the construction machine covers the stretch which lies between the portion lying in the working direction in front of the working region of the working means and the portion of the ground relating to the working region of the construction machine. The stretch to be covered by the construction machine is therefore dependent on the specified distance between the observed ground portion and the current working region of the working means. In this case it should be taken into account that an intervention in the machine control has to be carried out already when an object located in the ground is located at a specified safety distance in front of the working region of the working means. Characteristic reference points or reference lines in or outside the portion which lies in front of the working region of the working means and/or in or outside the portion of the ground in which the working region of the construction machine lies, for example outlines or axes of symmetry in the working direction in front of or behind the respective portions, can be established in order to calculate the time/path offset which is relevant here. The period in which the construction machine covers the stretch is dependent on the speed of advance of the construction machine. In order to obtain the current object signals, the time at which the working means of the construction machine is located at a specified safety distance in the working direction in front of the object may for example also be determined by means of a path length measurement.

One preferred embodiment of the invention provides for the predictive object signals and the current object signals to be image signals. The means for generating object signals in this preferred embodiment has an image recording unit which is configured such that a portion of the ground which lies in the working direction in front of the working region of the working means is recorded. The image recording unit may comprise one or more camera systems. If the image recording unit has a plurality of camera systems, the image segment may be compiled from a plurality of images which are each recorded with one camera system. Each camera system may however also be assigned its own image segment. The image segment should be selected such that all those regions in the area surrounding the objects which are relevant for controlling the construction machine are detected, it being possible for the image segment also to comprise regions which cannot be seen by the operator of the machine from the driving position.

The camera system may comprise one camera or two cameras (stereo camera system). If when recording with one camera a three-dimensional scene is represented on the two-dimensional image plane of the camera, a clear association is yielded between the coordinates of an object, the coordinates of the representation of the object on the image plane and the focal distance of the camera. However, the two-dimensional representation means that the depth information is lost.

It is sufficient for the invention if the camera system has only one camera, since in practice the curvature of the ground surface can be disregarded in the image segment recorded by the camera. Furthermore, only two-dimensional scenes, i.e. the outlines of the objects in one plane (ground surface), are relevant to the invention. However, the invention is not restricted to this.

In order to detect three-dimensional scenes and/or to take into account a curvature of the ground surface, the at least one camera system of the image recording unit may also be a stereo camera system which comprises two cameras which are arranged paraxially at a specified horizontal distance, in order to be able to obtain the depth information from the disparity according to the known methods.

The signal processing means is configured such that the portion of the ground recorded by the image recording unit is displayed on a display unit with a time delay. Consequently, the objects can be recognised on the display unit by the operator of the machine when the working region of the working means, in particular the milling drum, is located directly in front of the object, on the object or directly after the object, so that he can intervene in the machine control at the right time, although at this time neither he nor a camera might be able to detect the relevant image segment.

One further preferred embodiment provides for at least part of the working region of the working means to be visualised on the display unit, so that the operator of the machine can recognise the position of the objects in relation to the working region of the working means, in particular the working region of the milling drum. The working region can be visualised not only by delimiting lines, but also by coloured highlighting or hatching. The parts of the working region which are relevant here are the front and rear regions thereof, in particular the front region, which in practice may be estimated particularly poorly. The display unit is preferably designed such that the front and/or rear—in the working direction—delimiting line of the working region of the working means and optionally also the right-hand and left-hand lateral delimiting lines are displayed.

Very widely varying methods may be used to obtain the current object signals from the predictive object signals. In a preferred embodiment, the signal processing means is configured such that during the advance of the construction machine the object signals are read into a memory unit, with the predictive object signals which at certain times are read into the memory unit being read out of the memory unit and displayed as current object signals with a time delay which is dependent on the speed of advance of the construction machine. The object signals which are read out with a time delay may be time-coded object signals, i.e. signals provided with a time stamp which are decoded using the speed of advance of the construction machine, so that they are displayed with a delay. It is however also possible for the object signals to be path-coded signals, i.e. signals provided with a path-stretch mark which are decoded using the stretch covered by the construction machine. The predictive image data may for example be stored at certain intervals as a function of the position of the construction machine on the stretch to be covered, and may be read out as current image data and displayed once a specified stretch which is dependent on the geometric dimensions of the construction machine including its working means has been covered.

If the operator of the machine sees that an object, for example a manhole cover, is approaching the working region of the working means, in particular of the milling drum, he intervenes in the machine control, for example he raises the milling drum in relation to the surface of the ground. When the manhole cover has been passed over and lies behind the working region, he lowers the milling drum again. This reliably prevents damage to the manhole cover or the construction machine. The construction machine preferably has an actuation means with an operating element, which means is designed such that once the operating element has been actuated a control signal for an intervention in the machine control is generated, the control unit of the construction machine being configured such that the control unit, after receiving the control signal, intervenes in the machine control, for example it raises or lowers the milling drum, or stops the construction machine. Any conventional road milling machine possesses such an operating unit.

In principle, it is not necessary for the invention to record the objects situated in the ground with a camera and to display them on a display unit. An alternative embodiment of the invention which is particularly simple to realise dispenses with a representation of the objects with a correct relationship to the position of the working means. In this embodiment, the means for generating object signals is an actuation means with an operating element, which means is designed such that the predictive object signals are generated once the operating element has been actuated, the control unit being configured such that the control unit, after receiving a current object signal, intervenes in the machine control or triggers an alarm.

The means for generating object signals may have an image recording unit which is configured such that a portion of the ground which lies in the working direction in front of the working region of the working means is recorded, and which has a display unit for displaying this ground portion. The operator of the machine can thus recognise the object on the display unit, even if he cannot see it from the driving position. A recording and display unit is however not absolutely necessary. In the simplest case, a single predictive object signal can be generated by actuating an operating element of an actuation means, for example a button on an operator panel, if the outline of an object is approaching a reference point or a reference line. In such case, the reference point or the reference line may be a point provided on the construction machine or a line which is visible to the operator of the machine. Then, with a time delay, a current object signal which contains the information that an intervention in the machine control has to be carried out is obtained from the predictive object signal. This intervention in the machine control may take place automatically, i.e. once the operating element has been actuated the milling drum of the road milling machine is automatically raised at the right time if the manhole cover, optionally taking into account a safety distance, is level with the milling drum. Consequently, the current object signal is a control signal for the control unit of the construction machine for raising or lowering the milling drum. The current object signal may however also be an alarm signal which requests the operator of the machine to raise or lower the milling drum.

BRIEF DESCRIPTION OF THE DRAWINGS

Below, embodiments of the invention will be explained in greater detail with reference to the drawings, in which.

DETAILED DESCRIPTION

Figure 1A:
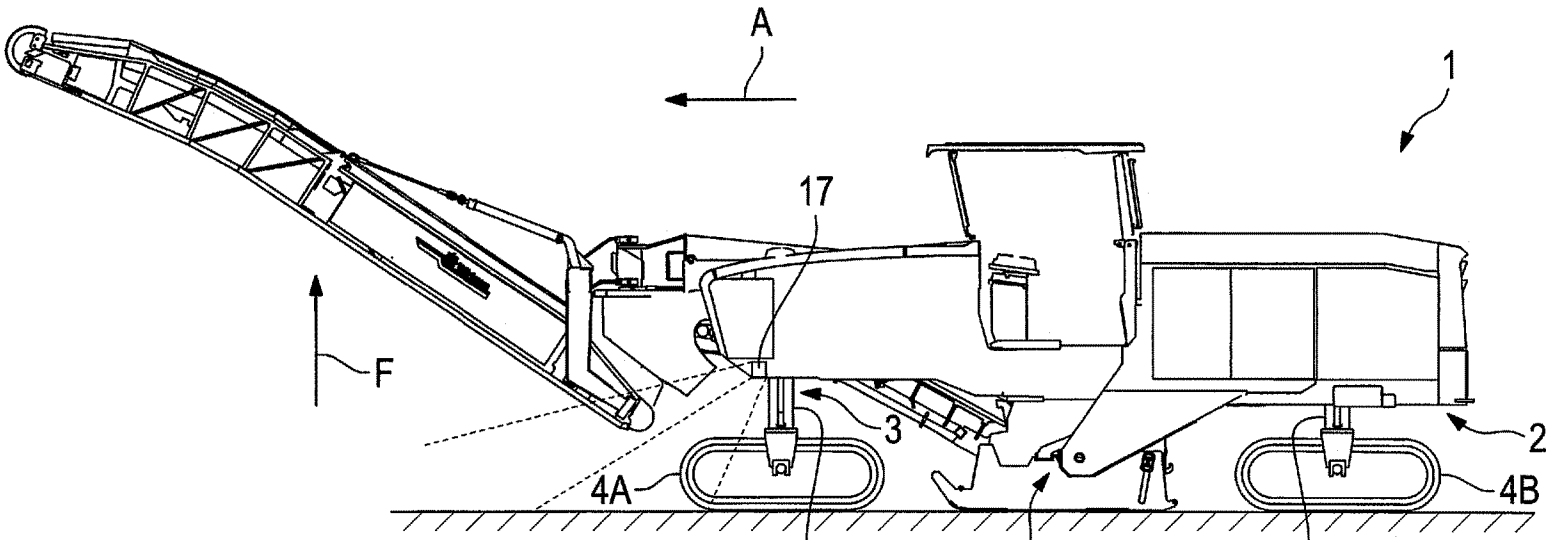
FIG. 1A is an embodiment of a road milling machine in a side view.
Figure 1B:
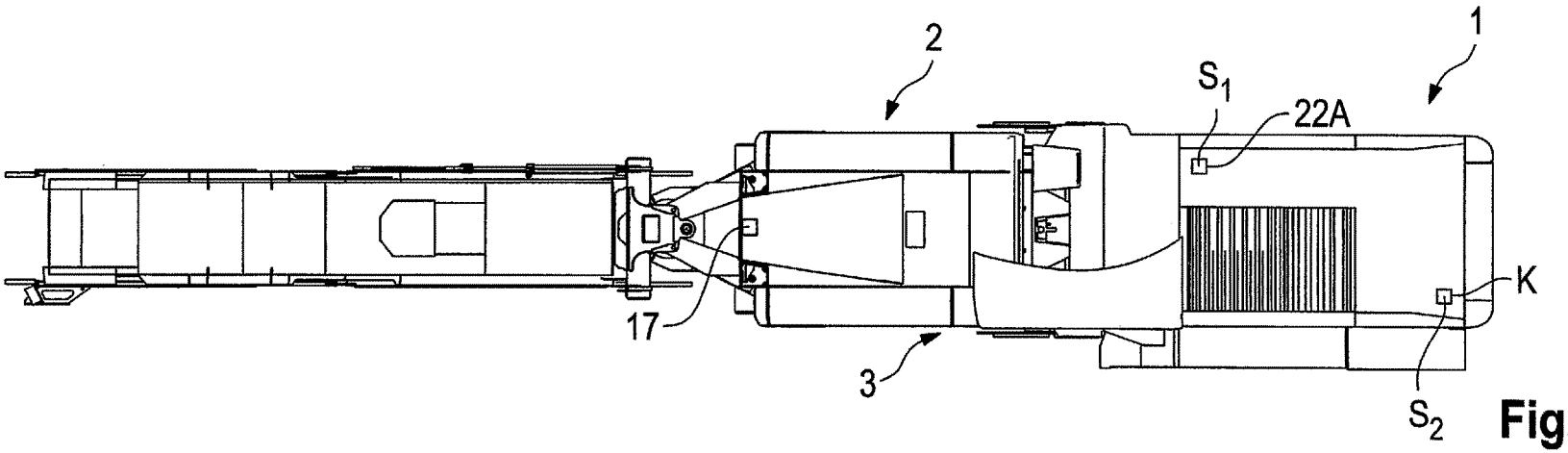
FIG. 1B is the road milling machine of FIG. 1A in a plan view.

FIGS. 1A and 18 show a side view and a plan view of a road milling machine as an example of a self-propelled construction machine. Since road milling machines as such are prior art, only those components which are relevant to the invention will be described here.

The road milling machine 1 has a machine frame 2 which is borne by an undercarriage 3. The undercarriage 3 has two front and two rear crawler tracks 4A, 4B which are fastened to front and rear lifting columns 5A, 5B. However, only one front or rear travelling gear may also be provided. The working direction (direction of travel) of the road milling machine is marked with an arrow A.

The crawler tracks 4A, 4B and lifting columns 5A, 5B form the drive means for the road milling machine for performing translatory and/or rotary movements on the ground. The machine frame 2 can be moved in terms of height and inclination relative to the ground by raising and lowering the lifting columns 5A, 5B. The road milling machine can be moved forwards and backwards using the crawler tracks 4A, 4B.

The road milling machine 1 possesses a working means for altering the ground. In this case, it is a milling means 6 with a milling drum 21 equipped with milling implements (FIGS. 3 to 7), which drum cannot however be recognised in FIGS. 1A and 18. The milled material is carried away using a conveying means F.

Figure 2:
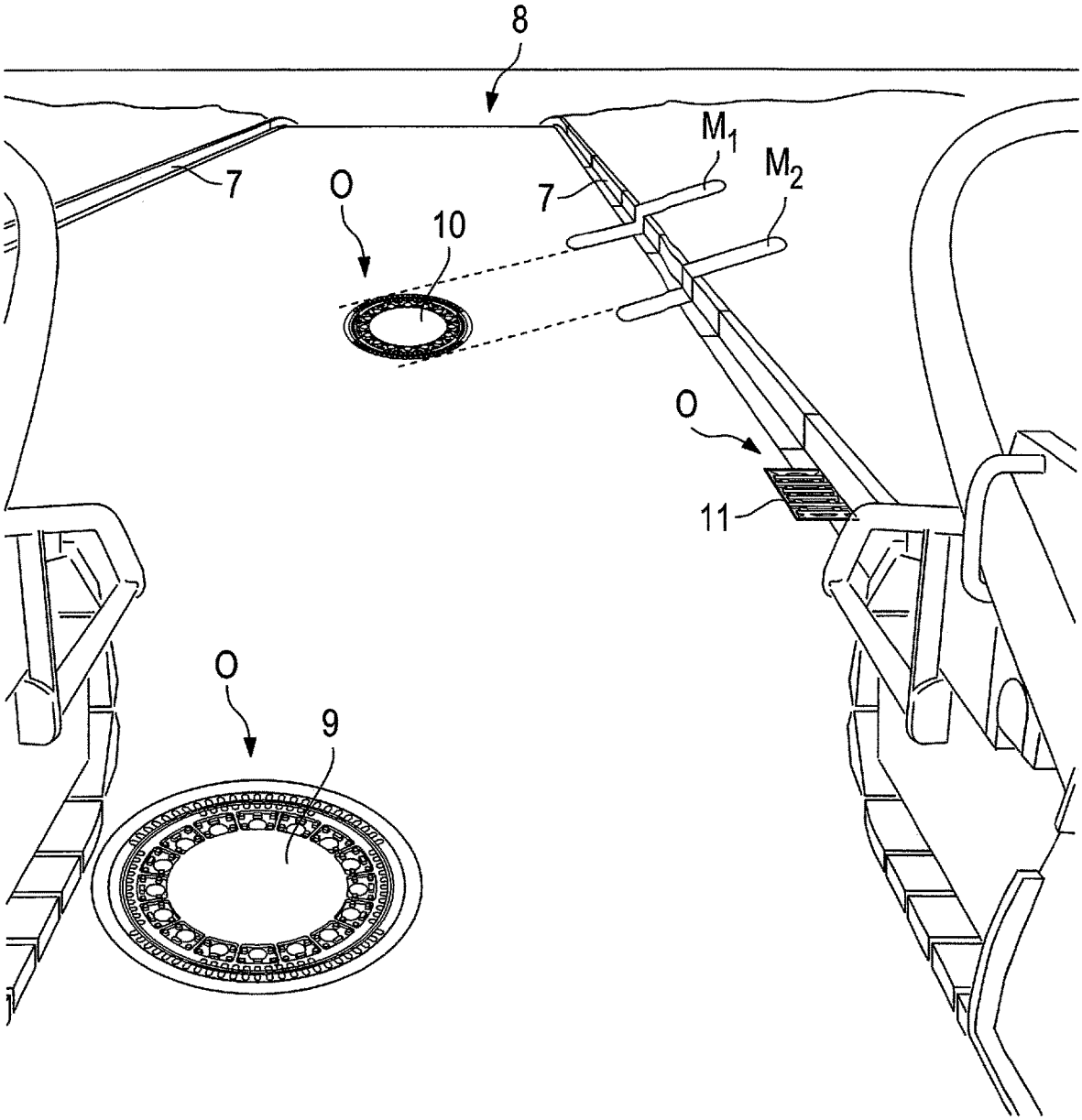
FIG. 2 shows the road surface which is to be worked with the road milling machine.

The road surface to be altered with a road milling machine is illustrated in FIG. 2. On the ground there runs a road 8 which is delimited laterally by curbstones 7. In this embodiment, the project is to mill off the surface of the road. In so doing it should be taken into account that certain objects O are located in the road, for example manhole covers in the middle of the road surface and storm drains at the side of the road surface. FIG. 2 shows two manhole covers 9, 10 and a storm drain 11 which, although passed over by the road milling machine, are not to be detected by the milling drum thereof. The view in FIG. 2 does not correspond to the field of view of the operator of the machine. The operator of the machine in the driving position of the construction machine cannot see the objects O in the road, since they are located directly in front of the construction machine or beneath the machine. The operator of the machine cannot recognise the manhole cover in particular when the milling drum is only a short way in front of the manhole cover, i.e. exactly at the time at which the operator of the machine has to raise the milling drum. This region can however also not be monitored using a camera owing to the milled material in the milling-drum housing flying around.

Since the operator of the machine cannot recognise the manhole covers 9, 10, in practice lateral markings are applied level with the manhole covers, these being designated $M_1$ and $M_2$ in FIG. 2. These markings are intended to enable the operator of the machine or another person to recognise the position of the manhole covers, so that the milling drum can be raised in good time. Such markings are however not necessary with the construction machine according to the invention.

Figure 8:
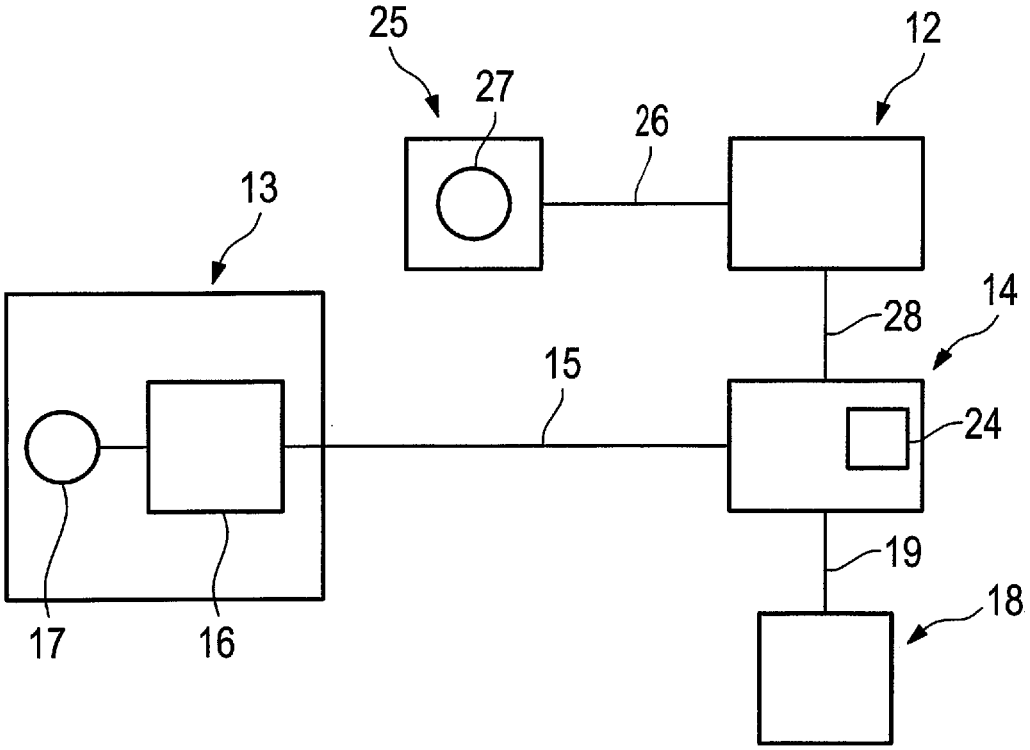
FIG. 8 is a block diagram with those components of the construction machine which are relevant to the invention.

The construction machine has a central control unit 12 for controlling the drive means for the travelling gears 4A, 4B and the lifting columns 5A, 5B (FIG. 8). Furthermore, the road miller possesses a means 13 for generating predictive object signals and a signal processing means 14, which are connected together via a data line 15. The signal processing means 14 is connected to the control unit 12 via a data line 28. The means 13 for generating predictive object signals possesses an image recording unit 16, which has a camera system 17 arranged on the machine frame 2 with which a portion of the ground to be worked, i.e. the road surface 8 with the manhole covers 9, 10 and storm drains 11, is recorded. Furthermore, the road miller possesses a display unit 18, for example an LC display, which is connected to the signal processing means 14 via a data line 19.

Figures 3A, 3B, 3C:
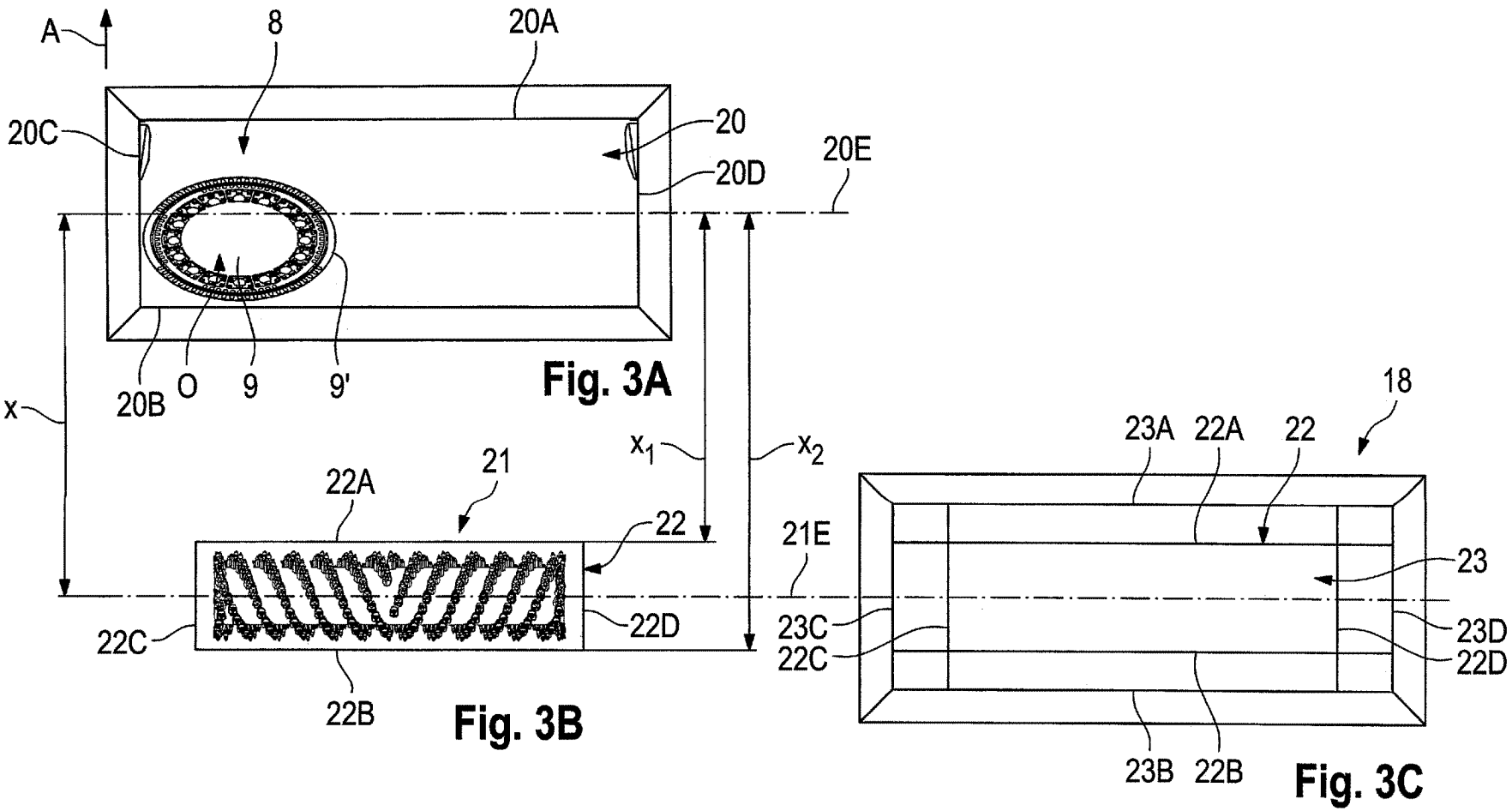
FIG. 3A to 3C show the field of vision of the camera system of the image recording unit of the means for generating predictive object signals, the milling drum and the display unit of the road milling machine in a simplified schematic view at a time at which a manhole cover is lying in the field of vision of the camera.

FIGS. 3A to 3C show a simplified schematic view of the field of vision 20 of the camera system 17 of the image recording unit 16 of the means for generating predictive object signals 13 (FIG. 3A), the milling drum 21 (FIG. 3B) and the display unit 18 (FIG. 3C) of the road milling machine 1. The field of vision of the camera system lies in a region which cannot be seen by the operator of the machine. The image recorded by the camera system is not displayed to the operator of the machine on the display unit.

The camera system may be a stereo camera system, or a camera system with only one camera. If the curvature of the ground surface is to be disregarded and/or only two-dimensional objects are taken into account, however, a camera system with only one camera is sufficient. Below, the camera system will therefore be referred to only as "camera".

The milling drum 21 has a rectangular working region 22 which is determined by the geometric dimensions of the cylindrical drum body. The working region 22 is delimited by a front—in the working direction—delimiting line 22A, a rear delimiting line 22B and lateral delimiting lines 22C, 22D. These lines mark the region at which the milling picks of the milling drum 21 penetrate into the surface of the ground. The working region 22 of the milling drum 21 is therefore understood to be a ground portion.

The milling drum 21 can be raised or lowered in relation to the ground surface by extending or retracting the lifting columns 5A, 5B in order to be able to set the milling depth. If the milling depth is changed, the rectangular working region 22 of the milling drum 21 will also change. A reduction in the milling depth results in a reduction in the distance between the front and rear delimiting lines 22A, 22B, whereas an increase in the milling depth results in an increase in the distance between the front and rear delimiting lines 22A, 22B. Since the milling depth relative to the ground and the geometric dimensions of the milling drum are known, the working region 22 of the milling drum 21 can be calculated.

The camera 17 detects a portion of the ground which cannot be seen by the operator of the machine in the driving position. In the field of vision 20 of the camera 17 there lies a portion of the ground to be altered which is passed over by the milling machine, which moves in the working direction A at a specified speed of advance v. The rectangular field of vision 20 of the camera 17 is delimited by a front and a rear delimiting line 20A, 20B and lateral delimiting lines 20C, 20D. The longitudinal axis 20E of the field of vision 20 lies in the working direction A at a specified distance x in front of the axis of rotation 21E of the milling drum 21 or of the longitudinal axis of the rectangular working region 22. This distance x is dependent on the arrangement and the angle of view (orientation) of the camera 17 on the machine frame 2 and on the arrangement of the milling drum 21 on the machine frame 2. The distance x1 or x2 between the longitudinal axis 20E of the field of vision 20 of the camera 17 and the front or rear delimiting line 22A, 22B respectively of the milling drum 21 is dependent not only on the arrangement and the angle of view of the camera 17 and the arrangement of the milling drum 21, but also on the geometric dimensions (diameter) of the milling drum 21 and the milling depth.

The longitudinal axis 20E of the field of vision 20 represents a reference line across which the objects O move while the construction machine advances. The outline of the objects O, for example the circular outline 9' of the manhole cover 9 moving towards the reference line 20E, contacts the line 20E, thereupon intersects the line at two intersection points, then contacts the line again at one point and finally leaves the field of vision 20 of the camera 17. FIGS. 3A to 3C show the manhole cover 9 at a time at which the manhole cover 9 is lying in the field of vision 20 of the camera 17.

The display unit 18 does not show the live image of the camera, but a recorded image (video), i.e. the image recorded by the camera with a time delay. The image segment 23 displayed on the display unit 18 is again delimited by front and rear delimiting lines 23A, 23B and also lateral delimiting lines 23C, 23D. In the present embodiment, the rectangular image segment 23 of the display unit 18 corresponds exactly to the field of vision 20 of the camera 17 in its geometric dimensions (FIG. 3C). The image segment 23 may however also be a reduced or enlarged segment if the display unit 18 has a zoom function. On the display unit 18, the working region 22 of the milling drum 21 is marked by its front and rear and also lateral delimiting lines 22A, 22B, 22C, 22D (FIG. 3B). The distance between the delimiting lines 22A, 22B, 22C, 22D is dependent on the dimensions of the milling drum 21 and the set milling depth. A change in the milling depth therefore leads to displacement of the front and rear delimiting lines 22A and 22B, which are superposed on the image which is recorded by the image recording unit and is displayed on the display unit 18 with a time delay.

The display unit 18 lies in the field of vision of the operator of the machine, so that the operator of the machine can recognise on the display unit when the object O, for example the manhole cover 9, is moving towards the milling drum 21.

Figures 4A, 4B, 4C:
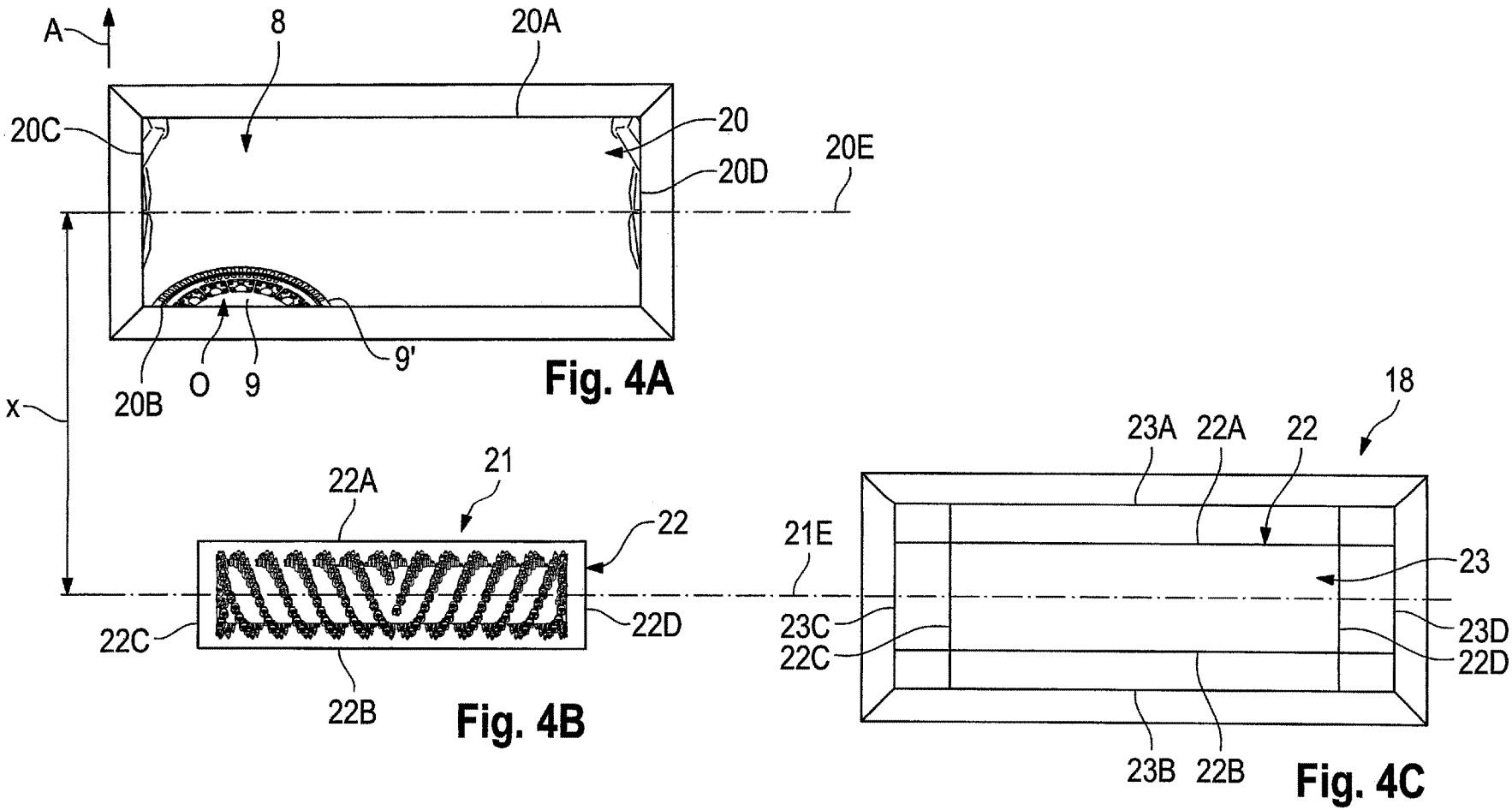
FIG. 4A to 4C show the field of vision of the camera system, the milling drum and the display unit at a time at which the manhole cover is leaving the field of vision of the image recording unit.
Figures 5A, 5B, 5C:
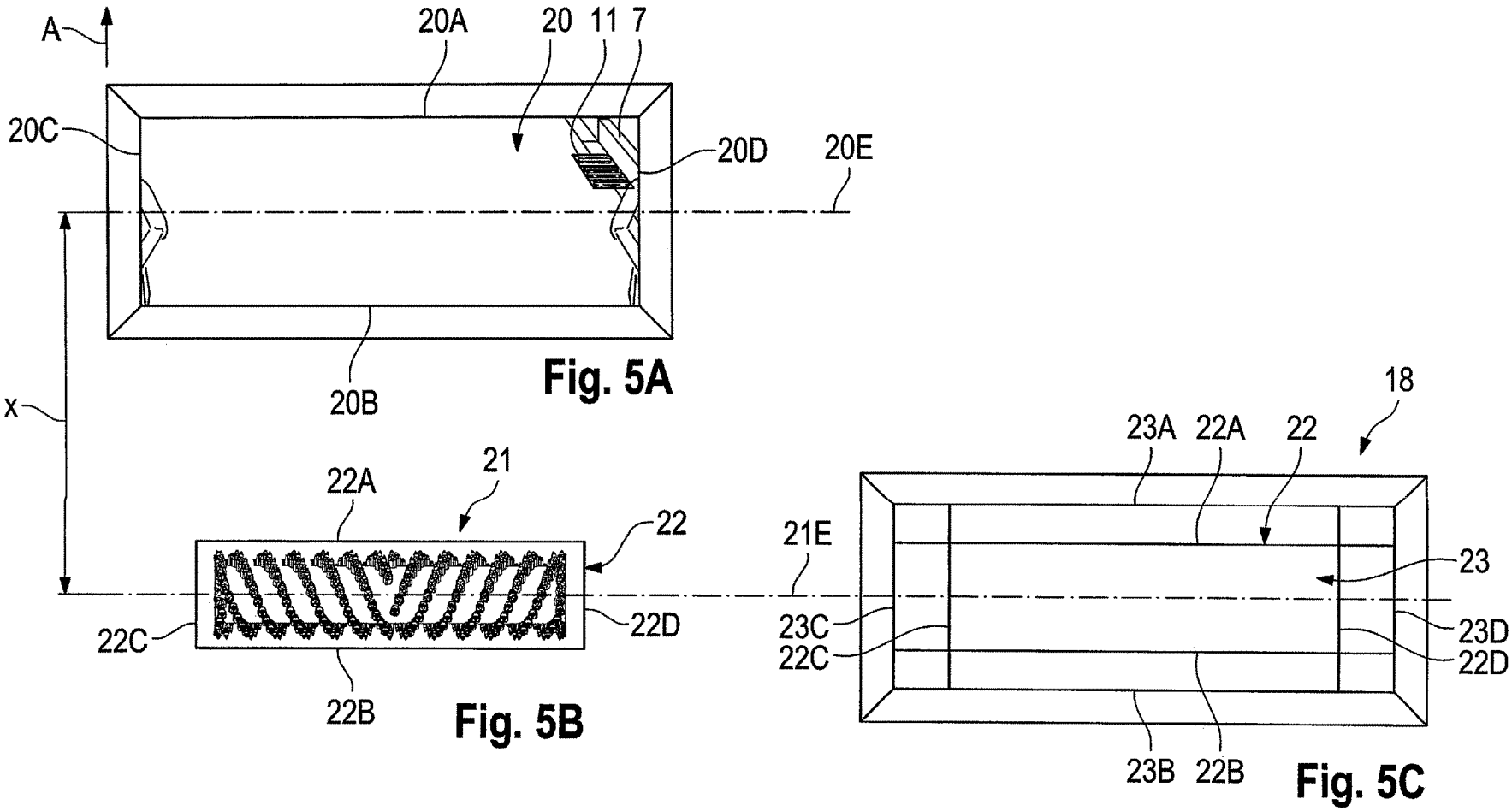
FIG. 5A to 5C show the field of vision of the camera system, the milling drum and the display unit at a time at which a storm drain is lying in the field of vision of the image recording unit.
Figures 6A, 6B, 6C:
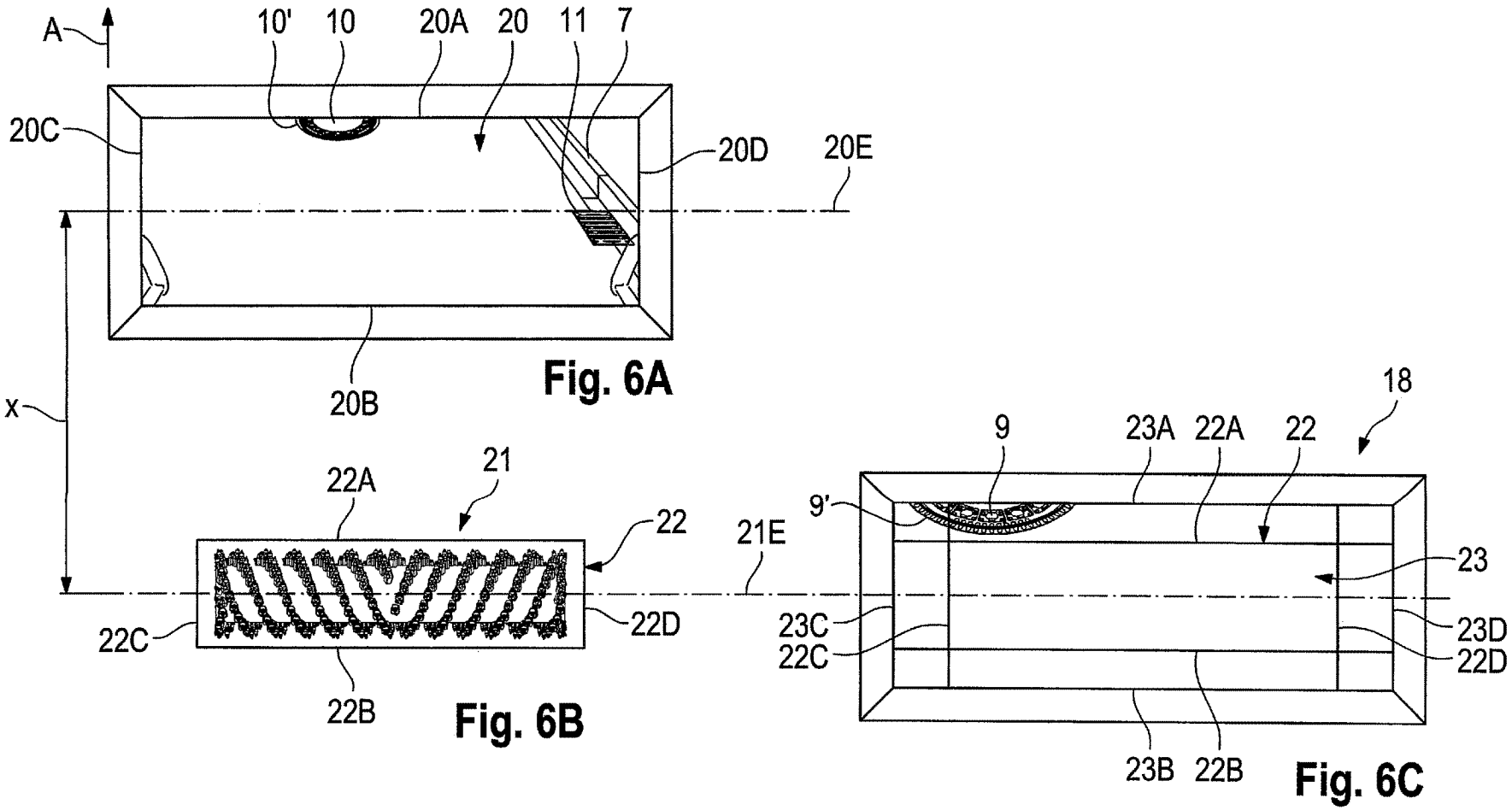
FIG. 6A to 6C show the field of vision of the camera system, the milling drum and the display unit at a time at which another manhole cover is entering the field of vision of the image recording unit.
Figures 7A, 7B, 7C:
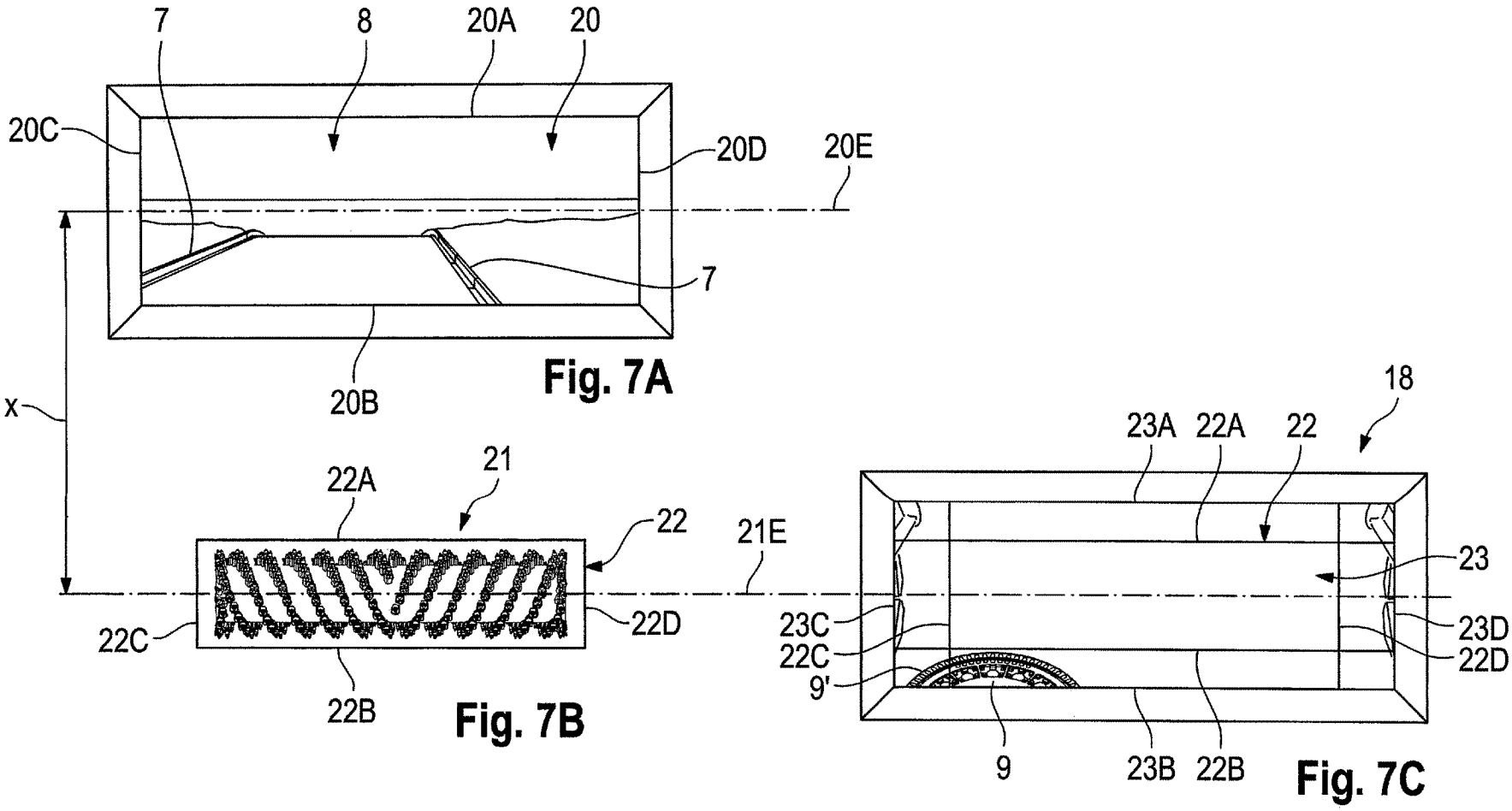
FIG. 7A to 7C show the field of vision of the camera system, the milling drum and the display unit at a time at which the other manhole cover has left the field of vision of the image recording unit.

FIGS. 4A to 4C show the field of vision 20 of the camera 17, the milling drum 21 and the display unit 18 at a time at which the manhole cover 9 is leaving the field of vision 20 of the camera 17, the manhole cover 9 not yet being displayed on the display unit 18; FIG. 5A to 5C show the field of vision 20 of the camera 17 and the display unit 18 at a time at which a storm drain 11 has entered the field of vision 20 of the camera 17, the manhole cover 9 however still not yet being displayed on the display unit 18; FIG. 6A to 6C show the field of vision 20 of the camera 17 and the display unit 18 at a time at which the second manhole cover 10 is entering the field of vision 20 of the camera 17 and the front edge of the first manhole cover 9 previously recorded is reaching the front delimiting line 22A of the working region 22; and FIG. 7A to 7C show the field of vision 20 of the camera 17 and the display unit 18 at a time at which the second manhole cover 10 has left the field of vision 20 of the camera 17 and the rear edge of the first manhole cover 9 has just passed over the rear delimiting line 22B.

The times at which the outline 9', 10' of the manhole cover 9, 10 touches the front and rear delimiting line 22A, 22B of the working region 22 of the milling drum 21, i.e. when the milling drum 21 moves across the manhole cover 9, 10 or the storm drain 11, are crucial for controlling the road milling machine 1. The milling drum 21 has to be raised if the outline 9', 10' of the manhole cover 9, 10 is at a specified safety distance in front of the front delimiting line 22A (FIG. 6C), and has to be lowered if the outline 9', 10' is at a specified safety distance behind the front delimiting line 22A (FIG. 7C).

In the present embodiment, the predictive object signals are image signals of the image recording unit 16. The image signals are image data of a digital camera 17 which records the relevant portion of the ground. The image data may be displayed as a sequence of individual images at successive times, or as a continuous sequence of images (video). The signal processing means 14 in this embodiment has a memory unit 24 into which the predictive image signals are read in succession and are read out again as current image signals once a time interval has elapsed. The object signals therefore represent time-coded signals. These image signals are displayed on the display unit 18 as images which show the current position of the object O, for example the manhole cover 9, 10, in relation to the milling drum 21. The length of this time interval is calculated from the quotient of the specified distance between the front or rear delimiting line 20A or 20B respectively of the field of vision 20 and the front or rear delimiting line 23A or 23B respectively of the image segment 23 and the speed of advance v at which the construction machine moves in the working direction A if the recorded and displayed image segment are on the same scale. This distance corresponds to the distance x between the longitudinal axis 20E of the field of vision and the axis of rotation 21E of the milling drum.

An alternative embodiment provides for the image recording unit in each case to record an image when the construction machine has covered a specified stretch or distance in the working direction A. This stretch should be as small as possible, for example only one or a few centimetres or even millimetres, so that the sequence of images can be detected with sufficient resolution on the entire stretch which is to be covered. In order to detect this stretch, the construction machine possesses a stretch counter ("step counter"). The image recording unit 18 consequently records a sequence of images which are associated with the stretch covered by the construction machine (number of "steps"). For example, the image recording unit 18 in each case records an image when the construction machine has moved by one centimetre in the working direction A on the stretch. The object signals therefore represent path-coded image signals, or image signals provided with a path-stretch mark. The path-coded image signals are displayed on the display unit 18 each time when the construction machine, once the image has been recorded, has covered a specified total stretch which corresponds to the distance x between the longitudinal axis 20E of the field of vision 20 and the axis of rotation 21E of the milling drum. The image recorded at a particular time, i.e. at a particular location of the stretch (path-stretch mark) at which the construction machine is located, is therefore not displayed on the display unit 18 until the construction machine has covered a certain total stretch which corresponds to a particular number of "steps", for example 100 "steps" of 1 cm each. For example, the number of revolutions of the drive means which drives the travelling gears, for example the drive shafts or drive wheels, etc., may be detected in order to determine the total stretch covered by the construction machine.

FIG. 6C shows how the outline 9' of the manhole cover 9 reaches the front delimiting line 22A of the working region 22 of the milling drum 21, so the operator of the machine has to raise the milling drum 21, whereas FIG. 7C shows how the outline 9' of the manhole cover 9 leaves the rear delimiting line 22B of the working region 22 of the milling drum 21, so the operator of the machine can lower the milling drum 21. The operator of the machine can accurately estimate on the display unit 18, optionally taking into account a safety distance, the time at which he has to intervene in the machine control.

The construction machine possesses an actuation means 25 which is connected to the control unit 12 of the construction machine via a control line 26. The actuation means 25 has an operating element 27 which the operator of the machine actuates if the outline of the manhole cover reaches the front delimiting line of the milling drum or leaves the rear delimiting line of the milling drum, taking into account a safety distance. The actuation means 25 then generates a control signal which the control unit 12 receives, so that the control unit 12 for example controls the lifting columns 5A, 5B in such a way that the milling drum 21 is raised or lowered.

The objects O and the milling drum 21 may be visualised on the display unit 18 for example also by hatching and/or coloured highlighting. The safety distance which is to be complied with may also be visualised for example by additional lines and/or hatching and/or coloured highlighting. A further display unit which shows the image recorded by the camera may also be provided.

FIGS. 3 to 7 show the case in which the construction machine covers a straight stretch. It is sufficient in practice to consider this case since the distance x between the longitudinal axis 20E of the field of vision 20 and the longitudinal axis 21E of the milling drum 21 is relatively small, so that any curvature can be disregarded on this stretch. However, even in the event that the construction machine is moving on any path curve whatsoever, the current object signals relating to the working region of the working means can be ascertained exactly using the known calculation methods, since the geometric relationships between the field of vision of the image recording unit and the working region of the working means are known. The course of the path curve covered by the construction machine may for example be ascertained from the stretch covered by the construction machine and the steering angles set at particular path-stretch marks. The course of the path curve in turn yields the turning and also the lateral displacement of the object between the time of recording and display of the image, which may however be ignored in practice since any curvature can be disregarded on the relevant stretch.

Below, a simplified embodiment of the invention which differs from the above embodiment in that the current conditions are not displayed on the display unit 18 is described with reference to FIG. 9A to 9B. With this embodiment, the live image currently recorded by the camera 17 is displayed on the display unit 18. The display unit 18 thus receives not the current, but the predictive, image signals of the camera 17. The representation on the display unit 18 does not otherwise differ from the representation of the above embodiment. The method of operation also corresponds to the above embodiment.

Figure 9A:
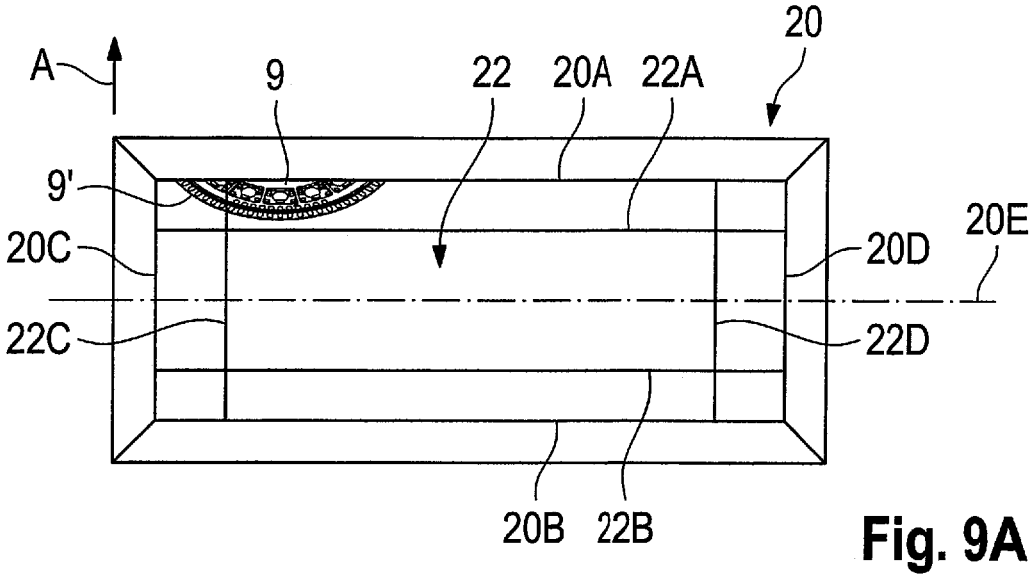
FIGS. 9A and 9B show the field of vision of the camera system at two successive times of a further embodiment, in which the image recorded by the camera is displayed on the display unit.
Figure 9B:
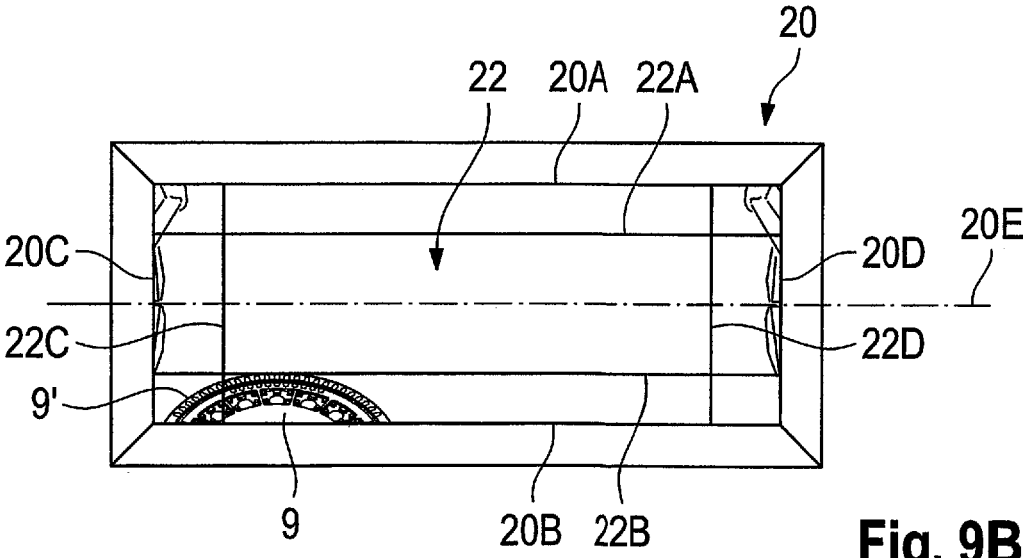

FIGS. 9A and 9B show the rectangular field of vision 20 of the camera 17, which is delimited by the front and rear delimiting lines 20A, 20B and also the lateral delimiting lines 20C, 20D. On the display unit 18, the working region 22 of the milling drum 21, which however does not correspond to the current conditions, is marked by the front and rear and also lateral delimiting lines 22A, 22B, 22C, 22D, which are superimposed on the camera image. These delimiting lines 22A, 22B, 22C, 22D are again displaced as a function of the geometric dimensions of the milling drum 21 used in each case and also the set milling depth. FIG. 9A shows the time at which the delimiting line 9' of the manhole cover 9 reaches the front delimiting line 22A of the working region 22 of the milling drum 21, whereas FIG. 9B shows the time at which the delimiting line 9' of the manhole cover 9 leaves the rear delimiting line 22B of the working region 22 of the milling drum 21. With the actuation of the operating element 27 at the time at which the manhole cover 9 reaches the front delimiting line 22A of the working region 22 of the milling drum 21, i.e. is at a specified safety distance in the working direction A in front of the front delimiting line 22A, the operator of the machine generates a first predictive object signal, and with the actuation of the operating element 27 at the time at which the manhole cover leaves the rear delimiting line 22B, i.e. is at a specified safety distance behind the rear delimiting line 22A, the operator of the machine generates a second predictive object signal. These object signals are then received by the control unit 12 with the specified time delay as control signals, so that the control unit raises or lowers the milling drum 21 at the right time or simply only stops the machine. Alternatively, the control signal may also trigger only a visual and/or acoustic and/or tactile alarm, to which the operator of the machine has to react accordingly. The time delay is again the quotient of the distance x between the longitudinal axis 20E of the field of vision 20 and the longitudinal axis 21E of the milling drum 21 and the speed of advance v of the construction machine. Instead of a time delay, the control can also be based on the stretch which has to be covered by the construction machine until the axis of rotation 21E of the milling drum 21 has reached the longitudinal axis 20E of the ground portion which has been previously recorded by the camera.

The invention claimed is:

1. A method of accounting for objects present in a ground surface across which a road milling machine travels, the road milling machine comprising a milling drum configured to work the ground surface in a rectangular working region, a machine frame supporting the milling drum and itself supported by a plurality of crawler tracks and one or more lifting columns, wherein the lifting columns are adjustable to raise or lower the milling drum to set a milling depth, and wherein the working region is determined at least in part by geometric dimensions of the milling drum and the milling depth thereof, the method comprising:

receiving and reading into a memory predictive object signals representing a position of one or more objects lying in a path of the road milling machine when the machine moves in a working direction and further in front of the working region; and determining current object signals relating to the working region from the predictive object signals, said current object signals representing the position of the one or more objects in a portion of the ground relating to the working region after an appropriate delay, wherein the determined current object signals are provided to a display unit such that the representative position of the one or more objects in the portion of the ground relating to the working region is displayed on the display unit after the delay.

2. The method of claim 1, comprising determining the current object signals relating to the working region from the predictive object signals by taking into account a distance covered by the road milling machine between: (a) the portion of the ground lying in the path of the road milling machine when the road milling machine moves in the working direction and further in front of the working region and; (b) the portion of the ground relating to the working region.

3. The method of claim 1, comprising determining the current object signals relating to the working region from the predictive object signals by taking into account a time delay as the appropriate delay, being dependent on a speed of the road milling machine between: (a) the portion of the ground lying in the path of the road milling machine when the road milling machine moves in the working direction and further in front of the working region and; (b) the portion of the ground relating to the working region.

4. The method of claim 1, comprising:

reading the predictive object signals out of the memory as current object signals once a specified distance has been covered by the road milling machine after a location associated with the predictive object signals.

5. The method of claim 4, wherein the specified distance is dependent on the determined speed of the road milling machine between: (a) the portion of the ground lying in the path of the road milling machine when the road milling machine moves in the working direction and further in front of the working region and; (b) the portion of the ground relating to the working region.

6. The method of claim 4, wherein the path of the road milling machine comprises a curved path, and the distance covered is determined further accounting for a course of the machine along the curved path.

7. The method of claim 1, comprising:

reading the predictive object signals into the memory in association with respective times during an advance of the road milling machine;

reading the predictive object signals out of the memory as current object signals once a time interval after the respective time associated with each of the predictive object signals has elapsed.

8. The method of claim 7, wherein the time interval is dependent at least in part on a determined speed of the road milling machine.

9. The method of claim 7, wherein the time interval is dependent on the determined speed of the road milling machine between: (a) the portion of the ground lying in the path of the road milling machine when the road milling machine moves in the working direction and further in front of the working region and; (b) the portion of the ground relating to the working region.

10. The method of claim 1, further comprising superimposing one or more delimiting lines with respect to the display of the portion of the ground relating to the working region.

11. The method of claim 10, comprising displacing the superimposed one or more delimiting lines with respect to changes in the milling depth.

12. The method of claim 1, wherein the path of the road milling machine comprises a curved path, the method further comprising determining the current object signals accounting for a course of the machine along the curved path.

* * * * *